United States Patent [19]

Lajovic et al.

[11] 4,265,432

[45] May 5, 1981

[54] DEGASSING MOLTEN METALS

[75] Inventors: Dimitri E. Lajovic, Strathfield; Hans Lassner, Winston Hills, both of Australia

[73] Assignee: Impact International Pty. Limited, Smithfield, Australia

[21] Appl. No.: 50,094

[22] Filed: Jun. 19, 1979

[30] Foreign Application Priority Data

Jun. 21, 1978 [AU] Australia ..... PD4810

[51] Int. Cl.[3] ..... C21C 5/48

[52] U.S. Cl. ..... 266/220; 75/46

[58] Field of Search ..... 266/220; 75/12, 46, 75/49

[56] References Cited

U.S. PATENT DOCUMENTS 3,504,899 4/1970 Breuer ..... 75/46

FOREIGN PATENT DOCUMENTS 632947 12/1949 United Kingdom .
662634 12/1951 United Kingdom .
1001134 8/1965 United Kingdom .
1291363 10/1972 United Kingdom .
1336166 11/1973 United Kingdom .

*Primary Examiner*—P. D. Rosenberg
*Attorney, Agent, or Firm*—Fleit & Jacobson

[57] ABSTRACT

Apparatus for the continuous degassing of molten metal is described comprising an inlet chamber adapted to receive untreated metal, an outlet chamber from which treated metal may be removed, a channel extending beneath and interconnecting the chambers to provide a metal flow path therebetween, the chambers are separated at least in part by an electrically conductive wall for defining with the molten metal in the channel an electrically conductive loop, means are provided for inducing a flow of current in the loop sufficient to maintain metal within the chambers and channel in a molten form and means are provided for introducing a purging gas beneath the surface of the molten metal.

15 Claims, 5 Drawing Figures

DEGASSING MOLTEN METALS

The present invention relates to the purification of molten metals. It is particularly well adapted for the removal of gaseous and other non-metallic inclusions from molten aluminium but it will be appreciated that the invention may be applied to the purification or treatment of other suitable metals in molten form.

In the purification of molten aluminium it is known to introduce a purging gas beneath the surface of the melt such that the gas bubbles to the surface of the melt and absorbs dissolved gases, particularly hydrogen. Many suitable purging gases are known such as nitrogen, argon, chlorine or mixtures of these gases. In particular, mixtures of chlorine with nitrogen or argon are commonly used in view of the reaction between the chlorine and dissolved hydrogen to form hydrogen chloride. In long established batch processing techniques hexochlorethane tablets have been introduced to release chlorine gas which bubbles through the melt to react with the dissolved hydrogen as described. The use of this gas, however, requires specialised fume disposal equipment to accommodate the toxic chlorine and its products. Furthermore, batch degassing processes prolong the metal holding time and increase metal loss through surface oxidation.

More advanced degassing processes employ an in-line treatment where a purging gas is introduced to the molten metal as it flows from the furnace to the casting station. These degassing units generally introduce the purging gas beneath some form of filter material such as alumina balls, alumina flakes, graphite particles or, in some cases, a rigid porous media filter. A flux layer may be applied to the filter material and the surface of the molten metal on the upstream side of the unit to absorb non-metallic inclusions and prevent the ingress of air or moisture into the melt while permitting the upward escape of rising gases.

These in-line degassing units generally require separate ingoing and outgoing chambers separated by baffles in order to contain the filter material and, if a flux is used, subsequently to separate any flux which may be carried over with the metal flow. They also require specially constructed external heating means to permit adequate heat transfer into both chambers.

It is an object of the present invention to provide an in-line degassing apparatus which will promote the separation of non-metallic inclusions and at the same time, ensure that the temperature of the molten metal is maintained at a sufficiently high value throughout the process.

According to the invention there is provided apparatus for the continuous treatment of molten metal comprising an inlet chamber adapted to receive untreated metal, an outlet chamber from which treated metal may be removed, a channel extending beneath and interconnecting said chambers to provide a metal flow path therebetween, said chambers being separated at least in part by an electrically conductive wall for defining with the molten metal in said channel an electrically conductive loop, means for inducing a flow of current in said loop sufficient to maintain metal within said chambers and channel in a molten form and means for introducing a purging gas beneath the surface of the molten metal.

A preferred embodiment of the invention will now be described, by way of example only, with reference to the accompanying drawings in which.

Figure 1:
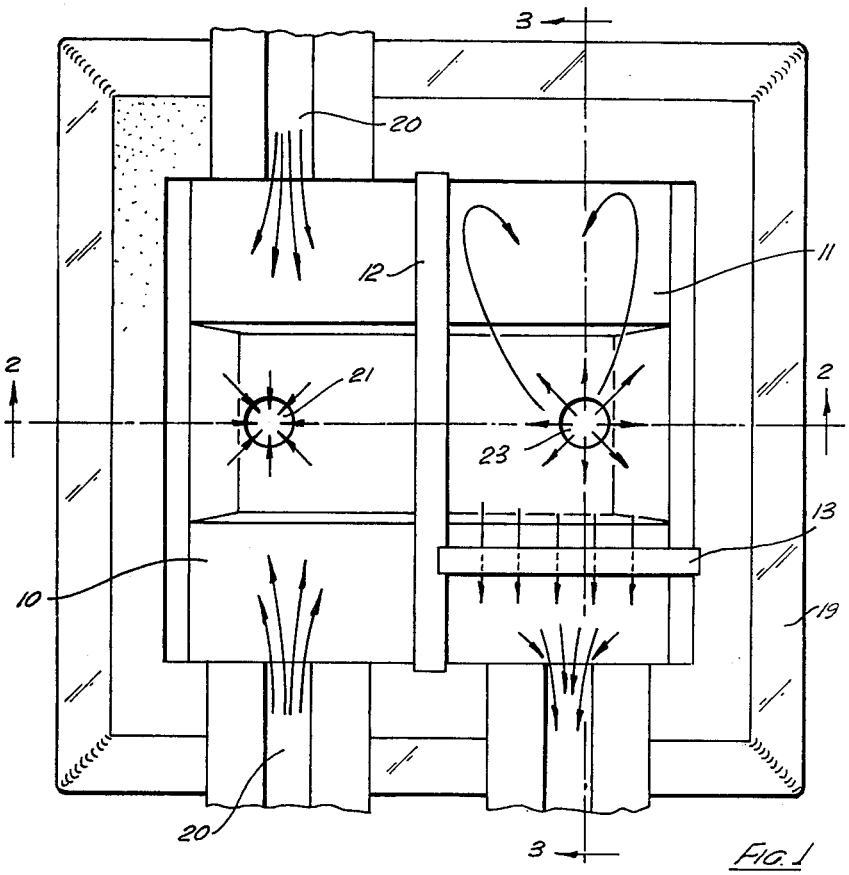
FIG. 1 is a plan view of a degassing apparatus according to the invention.
Figure 4:
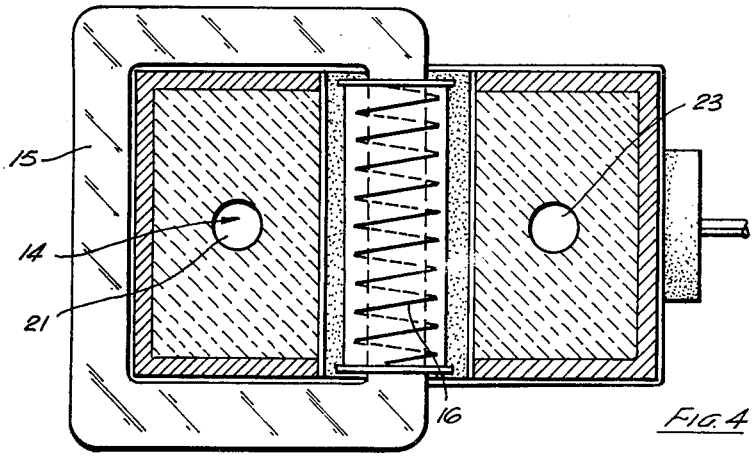
FIG. 4 is a section taken on line 4—4 of FIG. 2.

Referring to the drawings, the degassing apparatus of this particular embodiment has been developed from an induction channel furnace divided into an inlet chamber 10 and an outlet chamber 11 by a full depth transverse partition 12. The outlet chamber is further provided with a partly submerged baffle 13. The furnace includes a substantially U-shaped channel 14 filled with molten metal which acts in the same manner as a short-circuited single turn secondary winding in a transformer. The channel 14 is linked to a laminated iron core 15 which supports the primary winding 16, which, in one example, may comprise 168 turns connected to a 415 volt A.C. supply. Electrical energy induced from the primary winding into the channel of molten metal provides the heat energy necessary to maintain the metal in a molten state.

In order for the furnace to function, it is necessary to complete the electrical circuitry of the channel which would otherwise be interrupted by the transverse partition 12 if it were formed entirely of refractory material. Accordingly, an insert 17 of graphite or other suitable conductive material is provided in the lower part of the partition 12 so as to define with the molten metal in the channel an electrically conductive loop. The graphite insert is preferably sized so that its electrical resistance is minimal. In practice its resistance is 10% of the aluminium in the induction loop. In a particular 20 Kilowatt channel induction degassing furnace in use, the graphite insert had a resistance of 15 micro-ohms. The baffle 13 also incorporates a graphite insert 18 but this is solely to promote heat transfer. The remaining walls 19 throughout the furnace are constructed of refractory material.

In operation, molten aluminium is supplied from a primary furnace to the degassing apparatus through one or more inlet ports 20. The inlet ports 20 communicate with the inlet chamber 10 from which the metal enters the upstream vertical limb 21 of the loop 14. The molten metal then traverses the subsequent horizontal limb 22 and then the downstream vertical limb 23 to emerge into the outlet chamber 11. The metal leaves the outlet chamber 11 by flowing under the baffle 13 and then out through outlet port 24.

Figure 2:
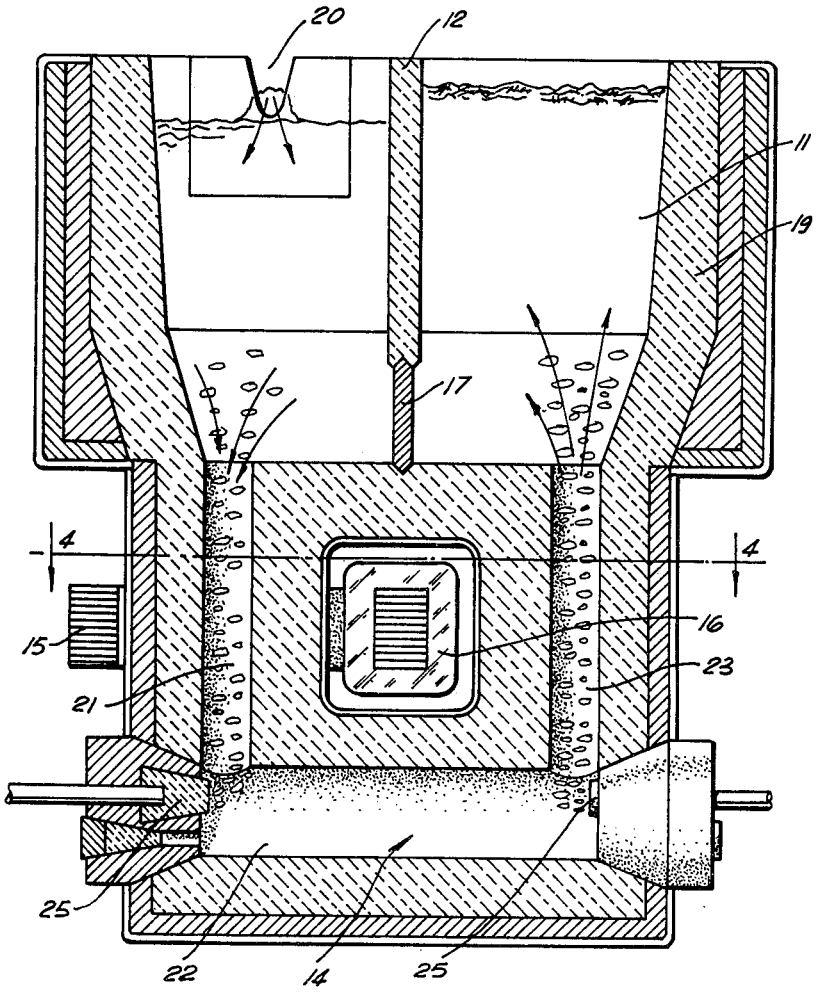
FIG. 2 is a section taken on line 2—2 of FIG. 1.
Figure 3:
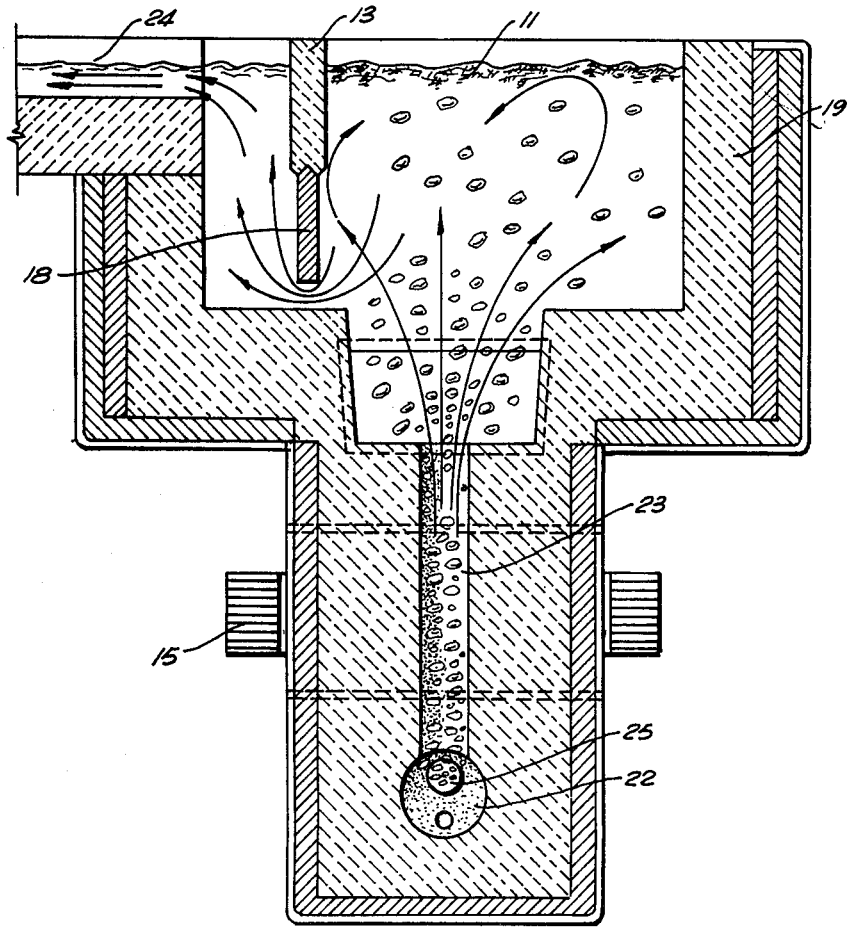
FIG. 3 is a section taken on line 3—3 of FIG. 1.
Figure 5:
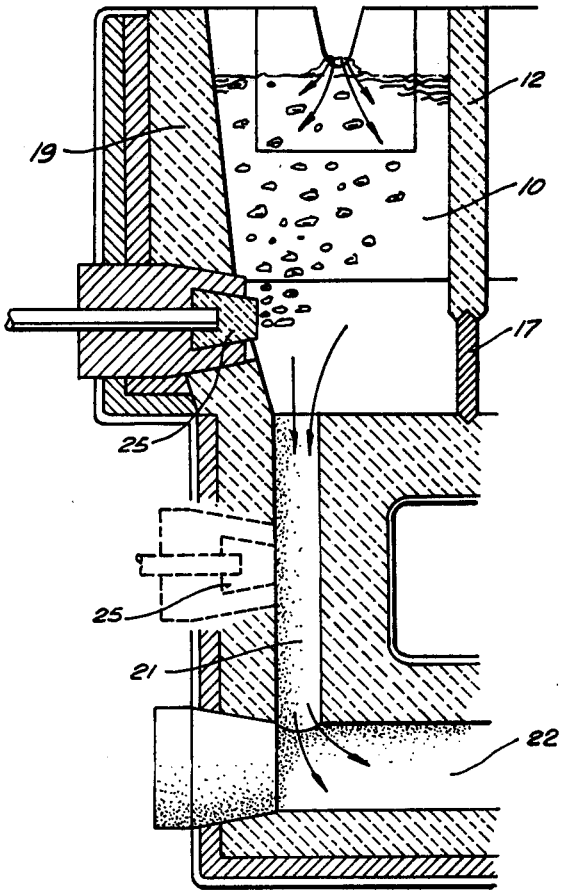
FIG. 5 is a part section similar to FIG. 2 showing alternative locations for admitting the purging gas.

Purging gas such as nitrogen, argon, chlorine or any of the known gas mixtures is admitted to the molten metal through one or more porous diffusers 25 which may be located above, adjacent or under the mouth of the vertical limbs of the induction loop as best shown in FIGS. 2 or 5. The illustrated alternatives of FIG. 5 also apply to the downstream side of the apparatus as well as the upstream side illustrated.

It has been found that the absorption of dissolved hydrogen gas into the purging gas bubbles is enhanced by the stirring action caused by the electrical current induced in the molten aluminium. Accordingly, it is preferable for two diffusers to be used with one located under each of the vertical limbs 21 and 23 of the induction loop as best shown in FIG. 2 in order to take advantage of the higher current density in these channels. In one unit in operation the vertical limbs are 50 mm in diameter and the current flowing through the loop is approximately 10,000 amperes. Tests of the outgoing metal show marked differences in quality of the treated metal between metal passed through the unit with electrical power on and metal passed through the unit with electrical power off. It is believed that the electromagnetic force field in the induction loop provides a strong turbulent recirculating flow field which greatly increases the contact surface area between the purging gas and the dissolved hydrogen and non-metallic inclusions. The metal velocity produced by the electromagnetic force field is considered proportional to the current induced in the metal. The induced current density is higher in the two vertical channels of the induction loop because their cross-sectional area is much smaller than any other part of the loop. Thus it is desirable that the purging gas passes through the two vertical limbs communicating respectively with the inlet and outlet chambers.

Non-metallic inclusions are mainly transported to the surface of the melt in the inlet and outlet chambers by the rising purging gas bubbles. If required, the apparatus may also be used with appropriate surface fluxes to promote separation and collection of inclusions. The baffle 13 prevents floating impurities from passing out of the apparatus with the treated metal.

Another advantage found in passing the purging gas bubbles through the two vertical limbs is that the build-up of inclusions on the channel walls is inhibited thus substantially eliminating the need for regular rodding-out practice as is required in normal melting and holding applications of channel induction furnaces.

In a particular unit treating 35 kg of aluminium per minute consistently good quality metal has been produced in a number of alloys. Frequent STRAUBE-Pfeiffer vacuum solidification tests have been carried out all showing zero bubbles at 2–5 Torr. In this unit argon has been used as the purging gas at 3 liters/min through the diffuser under the channel of the inlet chamber and 5 liters/min through the diffuser under the channel of the outlet chamber. The unequal gas flows promote forward flow through the channel.

Another advantage in using two diffusers as shown is that the level of metal in the outlet chamber can be made higher than the corresponding level in the inlet chamber. In one example a height difference of 50 mm was observed, even with an aluminium flow rate of 35 Kg/min through the unit apparatus. This pumping action can be varied by adjusting the purging gas flow rates in the two diffusers. The ability of the unit to provide an increased head in the outlet chamber provides an added advantage in that the apparatus does not require the significant pressure head which is necessary for some mechanical filters or other in-line degassing units using beds of tabular alumina or other granular materials.

The use of a modified induction furnace such as that described above as an in-line degassing unit provides a relatively simple means of maintaining the temperature of the molten metal whilst providing turbulence which promotes the mixing of the purging gas with associated improvements in the removal of non-metallic inclusions. It will be appreciated, however, that although the invention has been described with reference to this specific example, it is not limited to it and may be embodied in many other forms.

The present invention may also be applied, for example, to the removal of magnesium from molten aluminum by chemical reaction with a chlorine purging gas.

We claim:

1. Apparatus for the continuous treatment of molten metal comprising an inlet chamber adapted to receive untreated metal, an outlet chamber from which treated metal may be removed, a channel extending beneath and interconnecting said chambers to provide a metal flow path therebetween, said chambers being separated at least in part by an electrically conductive wall for defining with the molten metal in said channel an electrically conductive loop, means for inducing a flow of current in said loop sufficient to maintain metal within said chambers and channel in a molten form and means for introducing a purging gas beneath the surface of the molten metal.

2. Apparatus as defined in claim 1 wherein said channel is substantially U-shaped in form, having a pair of spaced, vertically extending limbs.

3. Apparatus as defined in claim 2 wherein said purging gas is admitted to said molten metal at at least one location within said channel.

4. Apparatus as defined in claim 3 wherein said purging gas is admitted at or adjacent the base of at least one of said vertically extending limbs.

5. Apparatus as defined in claim 4 wherein said purging gas is admitted at or adjacent the base of both said vertically extending limbs.

6. Apparatus as defined in claim 5 wherein the flow rate of purging gas supplied to the downstream limb is greater than that supplied to the upstream limb.

7. Apparatus as defined in claim 2 wherein said purging gas is admitted at a location above said channel.

8. Apparatus as defined in claim 1 wherein said outlet chamber is provided with a baffle downstream of said channel and extending into the chamber from above the surface of the metal thereby to prevent material on said surface from leaving said outlet chamber with said treated metal.

9. Apparatus as defined in claim 8 wherein said baffle is comprised of graphite.

10. Apparatus as defined in claim 1 wherein said means for inducing a flow of current in said loop comprises a laminated iron core linking said channel and provided with a primary winding, said loop defining a short-circuited secondary winding.

11. Apparatus as defined in claim 1 wherein said conductive wall is comprised of graphite.

12. Apparatus as defined in claim 1 wherein said gas is introduced through a porous diffuser located in a plug inserted in a wall of said apparatus.

13. Apparatus as defined in any one of the preceding claims for degassing molten aluminum.

14. Apparatus as defined in claim 13 wherein said gas is selected from the group consisting of argon and nitrogen.

15. Apparatus as defined in claim 1 wherein said gas is chlorine.

* * * * *